US011363887B2

(12) United States Patent
Sun

(10) Patent No.: US 11,363,887 B2
(45) Date of Patent: Jun. 21, 2022

(54) BLEACHER SEAT

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/099,807

(22) Filed: Nov. 17, 2020

(65) Prior Publication Data

US 2021/0307517 A1 Oct. 7, 2021

(30) Foreign Application Priority Data

Apr. 3, 2020 (CN) ..... CN202020466638

(51) Int. Cl.
*A47C 1/16* (2006.01)
*A47C 4/02* (2006.01)

(52) U.S. Cl.
CPC ..... *A47C 1/16* (2013.01); *A47C 4/022* (2013.01)

(58) Field of Classification Search
CPC ..... A47C 4/02; A47C 9/10; A47C 1/16
USPC ..... 297/17, 217.7
See application file for complete search history.

(56) References Cited

U.S. PATENT DOCUMENTS

| | | | | |
|---|---|---|---|---|
| 8,899,686 | B1 * | 12/2014 | Kim | A47C 5/10 297/440.11 |
| 9,247,817 | B2 * | 2/2016 | Grace | A47C 4/04 |
| 2014/0138989 | A1 * | 5/2014 | Homans | A47C 4/02 297/16.1 |
| 2020/0405055 | A1 * | 12/2020 | Sun | A47C 1/16 |

* cited by examiner

*Primary Examiner* — Sarah B McPartlin
(74) *Attorney, Agent, or Firm* — WPAT Law, P.C.; Anthony King

(57) ABSTRACT

A bleacher seat having a cloth cover, tube insertion sleeves and a bleacher seat support assembly. The bleacher seat support assembly has two foot pad tube assemblies, two back tubes, four tube plugs, four seat tubes, a middle cross tube, two connectors, and two elastic ropes. Each connector is of a four-way connecting port structure. Horizontal connecting ports of the two connectors are respectively connected to two ends of the middle cross tube, front connecting ports of the two connectors are respectively connected to the foot pad tube assemblies, two upper connecting ports which are internally communicated with each other are formed in the upper end of each connector, each upper connecting port is connected to the lower end of one seat tube, and the upper end of each rear seat tube is connected to one back tube.

20 Claims, 8 Drawing Sheets

BLEACHER SEAT

BACKGROUND OF THE INVENTION

1. Technical Field

The utility model belongs to the technical field of seats, and particularly relates to a bleacher seat.

2. Description of Related Art

Nowadays, the vigorous development of social productivity has greatly improved the creature comfort and spiritual pursuit of people and brought more large-scale sports matches, concerts and evening parties, which in turn promote the emergence of derivatives such as movable bleachers and bleacher seats, wherein movable bleacher seats not only need to be designed to be steady and firm, but also should be attractive, durable, and easy to assemble.

In general, traditional bleacher seats are integrally formed by plastic through one-time die casting, or are formed by the combination of a non-detachable hard frame and a soft cloth cover. However, both types of bleacher seats are inconvenient to carry and cannot satisfy the requirement for small-volume storage. In view of these defects, existing bleacher seats have to be improved to be used more conveniently.

BRIEF SUMMARY OF THE INVENTION

To solve the problems that existing bleacher seats are large in size, inconvenient to carry and poor in user experience, the objective of the utility model is to provide a bleacher seat, which is able to effectively improve the sitting conform of users in a long time, easy to disassemble, fold and store, and convenient to carry.

To fulfill the aforesaid objective, the following technical solution is adopted by the utility model:

A bleacher seat comprises a cloth cover, tube insertion sleeves and a bleacher seat support assembly, wherein the bleacher seat support assembly comprises two foot pad tube assemblies, two back tubes, four tube plugs, four seat tubes, a middle cross tube, two connectors, and two elastic ropes;

each connector is of a four-way connecting port structure, horizontal connecting ports of the two connectors are respectively connected to two ends of the middle cross tube, front connecting ports of the two connectors are respectively connected to the foot pad tube assemblies, two upper connecting ports which are internally communicated with each other are formed in the upper end of each connector, each upper connecting port is connected to the lower end of one seat tube, and the upper end of each rear seat tube is connected to one back tube;

The four tube plugs are respectively installed at upper ports of two front seat tubes and upper ports of the two back tubes; each elastic rope has an end fixed to the tube plug at the upper end of the corresponding back tube and then sequentially penetrates through the back tube on the same side, the seat tube at the lower end of the back tube, the two communicated upper connecting ports of the corresponding connector, and the corresponding front seat tube to be fixed to the tube plug on the corresponding front seat tube; and The four corners of the cloth cover respectively sleeve the upper ends of the two front seat tubes and the upper ends of the two back tubes by means of the tube insertion sleeves.

Furthermore, the two upper connecting ports in the upper end of each connector are distributed in a U shape or a V shape and are respectively located at a front end and a rear end of the upper surface of the connector.

Furthermore, the connectors are plastic connectors.

Furthermore, each foot pad tube assembly comprises a foot pad tube, a hook-type front pad and a rear pad, wherein the foot pad tube is formed by connecting a long tube segment and a flat hook segment, the head of the long tube segment is inserted into the front connecting port of the corresponding connector, and a pin is arranged at a position, close to the head, of the long tube segment and is buckled in an arc-shaped clamping groove of the front connecting port of the corresponding connector; a small hole is formed in a position, close to the hook segment, of the long tube segment, and a clamping protrusion on the upper surface of the rear pad is clamped in the small hole; and a clamping groove is formed in the surface of the hook-type front pad, and the hook segment is clamped in the clamping groove.

Furthermore, the long tube segment is a round tube, the upper surface of the rear pad is a concave arc surface matched with the outer wall of the round tube, and the lower surface of the rear pad is a horizontal plane.

Furthermore, the hook-type front pad and the rear pad are plastic pads; or, the food pad tube is a metal tube.

Furthermore, the bleacher seat further comprises a storage bag, wherein the cloth cover, the tube insertion sleeves and the bleacher seat support assembly are stored in the storage bag.

Furthermore, notches allowing knots at head ends of the elastic ropes to be taken out and assembled are formed in side walls of the tube plugs, and the head ends of the elastic ropes are arranged in inner cavities of the tube plugs via the notches.

Furthermore, lower ends of the back tubes are designed as insertion bars with outer circles matched with inner circles of the seat tubes, and the insertion bars are inserted into the seat tubes.

Compared with the prior art, the utility model has the following beneficial effects: the bleacher seat is simple, attractive, elegant, firm and durable in structure, easy to disassemble, fold and store, and convenient and fast to assemble and dissemble, accords with the ergonomics sitting posture, and can be comfortably used by users.

In the figures: 1, storage bag; 2, cloth cover; 3, bleacher seat support assembly; 4, foot pad tube assembly; 5, connector; 6, middle cross tube; 7, elastic rope; 8, back tube; 9, tube insertion sleeve; 10, rear pad; 11, movable bleacher; 12, tube plug; 13, insertion bar; 14, seat tube; 15, self-tapping screw; 16, foot pad tube; 17, hook-type front pad; 18, pin; 19, clamping protrusion; 20, arc-shaped clamping groove; 21, knot; 22, notch.

DETAILED DESCRIPTION OF THE INVENTION

The technical solution of the invention is further described and explained below with reference to specific embodiments to be understood more clearly. Those skilled in the art can easily appreciate other advantages and effects of the invention by referring to the contents in the specification. The utility model can also be implemented or applied in other different forms, and various modifications or transformations can be made to the details in the specification on the basis of different viewpoints and different applications without departing from the spirit of the utility model.

Figure 2:
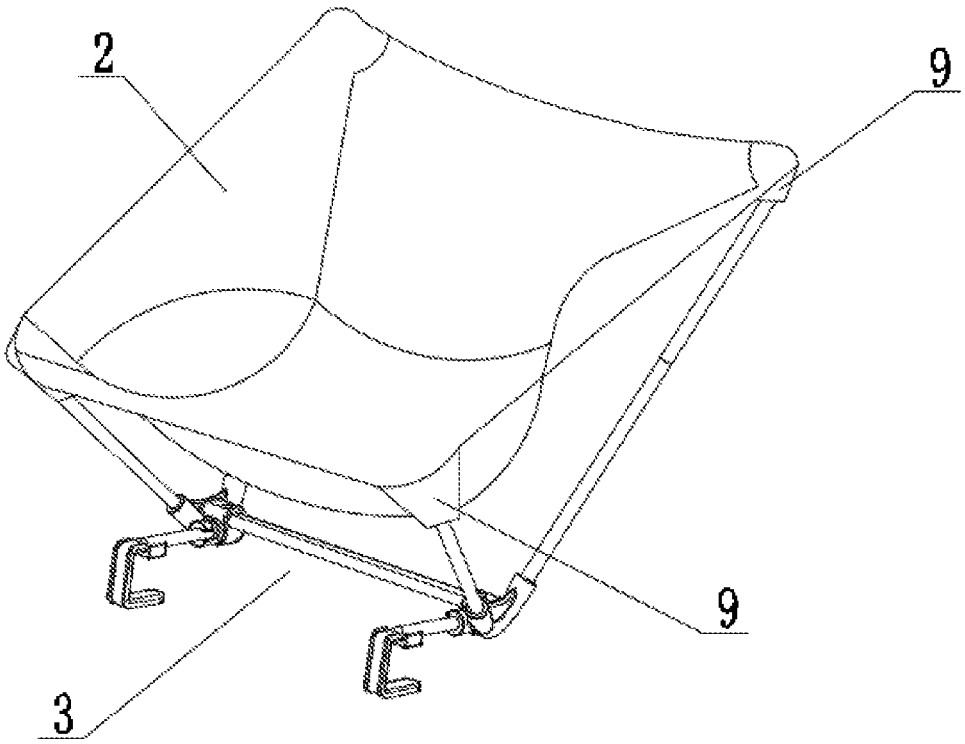
FIG. 2 is a perspective view of the bleacher seat in an unfolded state.

This embodiment discloses a bleacher seat which comprises a cloth cover 2, tube insertion sleeves 9 and a bleacher seat support assembly 3, wherein as shown in FIG. 2 which is a perspective view of the bleacher seat in an unfolded state, the cloth cover 2 sleeves the bleacher seat support assembly 3 by means of the tube insertion sleeves 9 at the four corners and is spread out.

Figure 4:
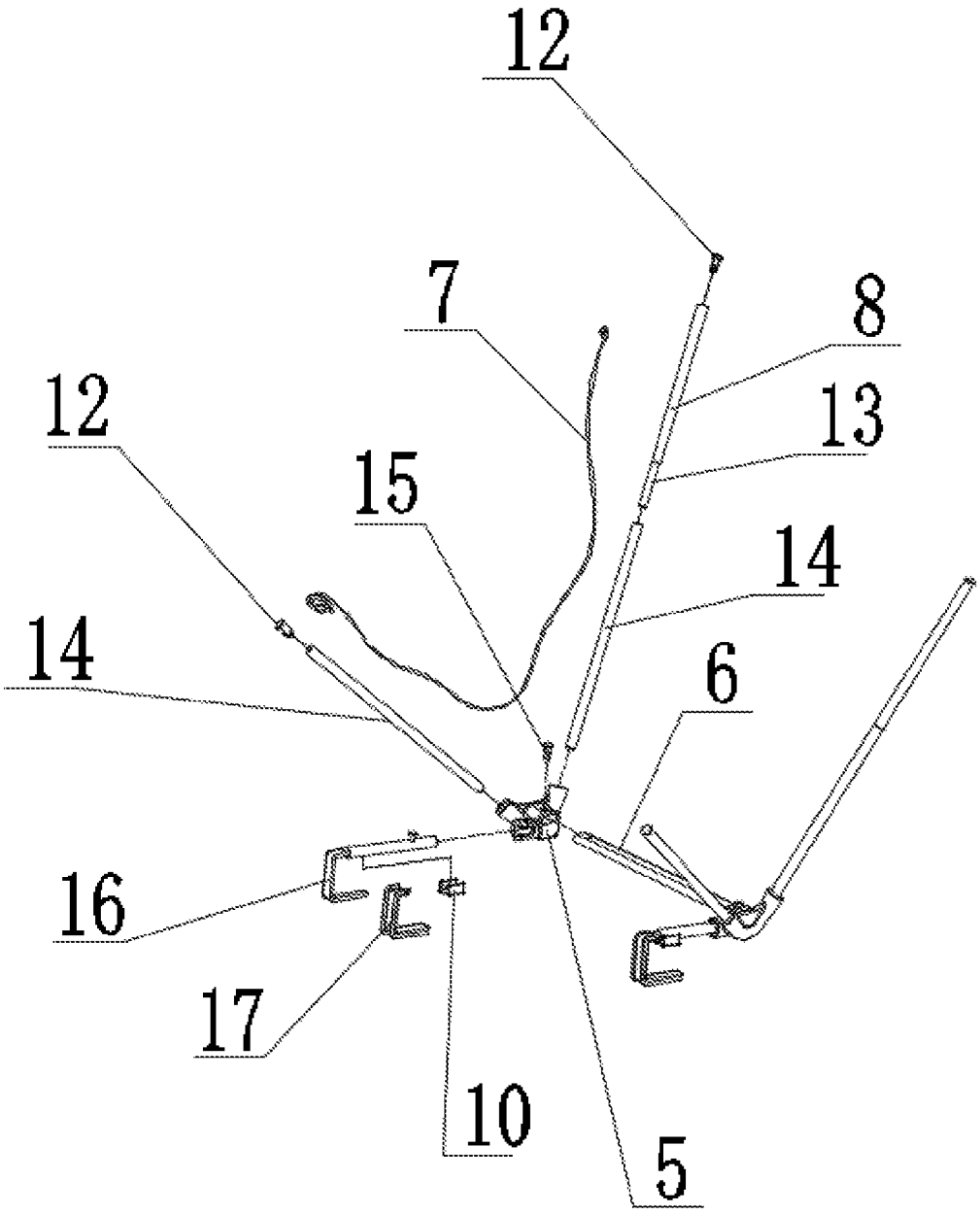
FIG. 4 is an exploded view of one side of the bleacher seat.
Figure 5:
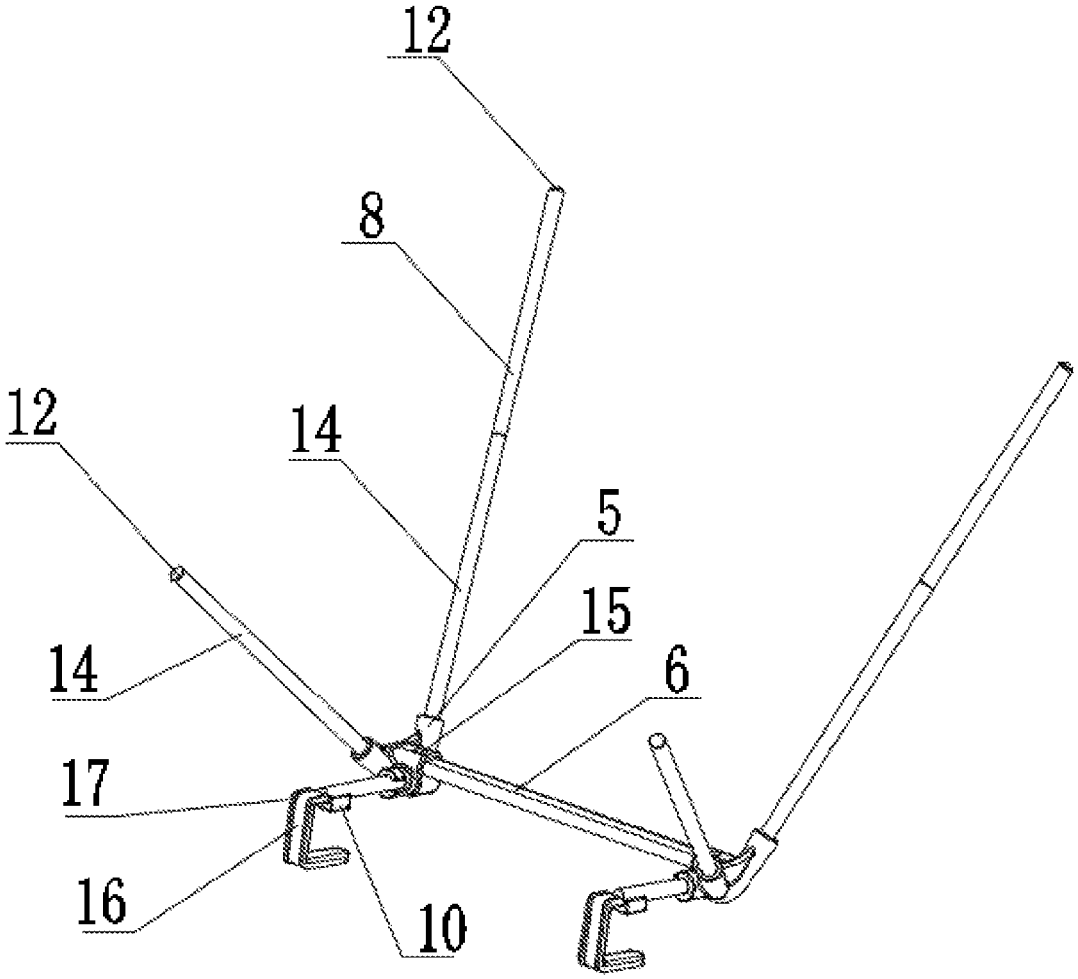
FIG. 5 is an assembled diagram of a bleacher seat support.

As shown by FIG. 5 which is an assembled diagram of the bleacher seat support assembly 3 and FIG. 4 which is an exploded view of one side of the bleacher seat, the bleacher seat support assembly 3 mainly comprises two foot pad tube assemblies 4, two back tubes 8, four tube plugs 12, four seat tubes 14, a middle cross tube 6, two connectors 5, and two elastic ropes 7, wherein each of the two connectors 5 is of a four-way connecting port structure, horizontal connecting ports of the two connectors 5 are respectively connected to the two ends of the middle cross tube 6, front connecting ports of the two connectors 5 are respectively connected to the foot pad tube assemblies, two upper connecting ports which are internally communicated with each other are symmetrically formed in the upper end of each connector 5, each upper connecting port is connected to the lower end of one seat tube, and the upper end of each of the two rear seat tubes is connected to one back tube 8;

The four tube plugs 12 are respectively installed in upper ports of the two front seat tubes 14 and upper ports of the two back tubes 8; and each elastic rope 7 has an end fixed to the tube plug 12 at the upper end of the corresponding back tube 8 and then sequentially penetrates through the back tube 8 on the same side, the seat tube 14 at the lower end of the back tube 8, the two communicated upper connecting ports of the corresponding connector 5, and the corresponding front seat tube to be fixed to the tube plug 12 on the corresponding front seat tube;

The four corners of the cloth cover respectively sleeve the upper ends of the two front seat tubes and the upper ends of the two back tubes by means of the tube insertion sleeves.

Figure 7:
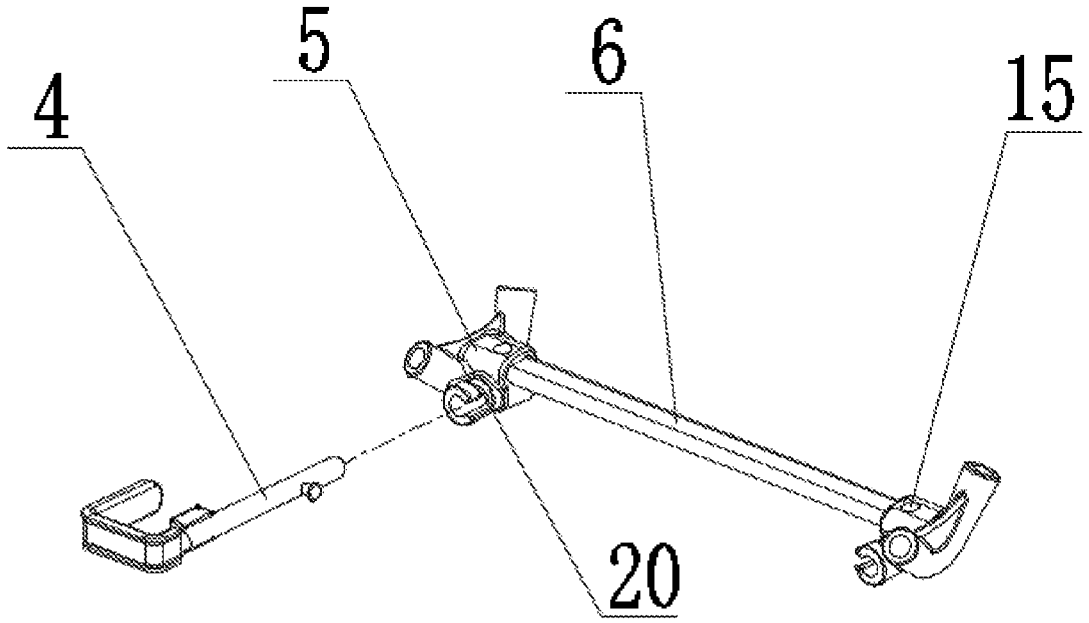
FIG. 7 is an assembly diagram of the foot pad tube assembly.
Figure 8:
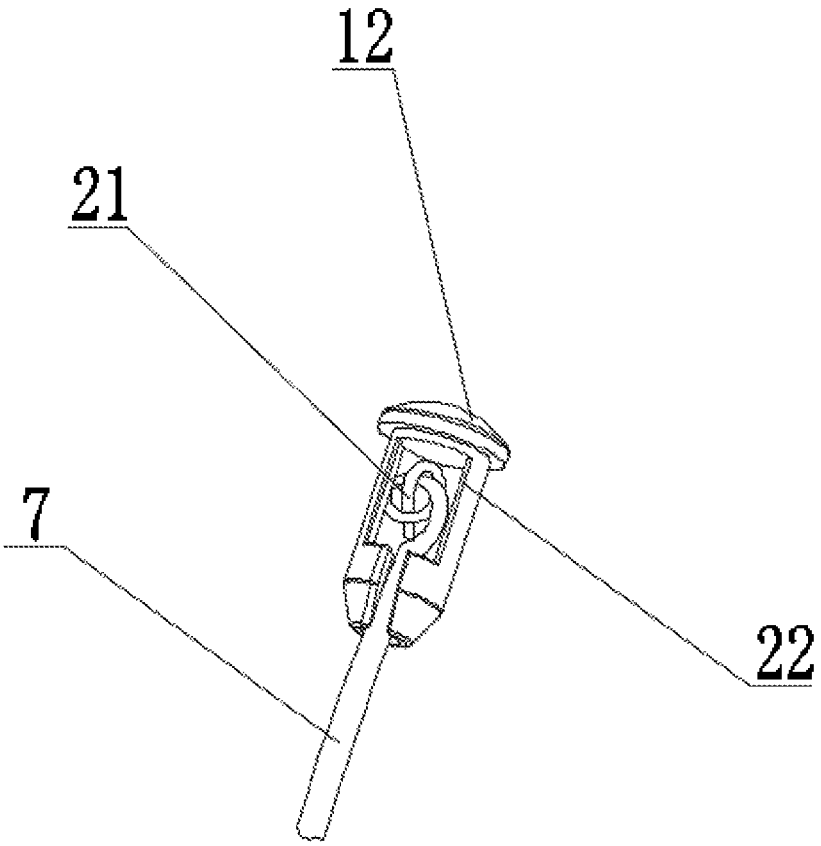
FIG. 8 is a schematic diagram of a tube plug for buckling an elastic rope.

In this embodiment, the foot pad tube assemblies 4 are assembled on the connectors 5 (as shown in FIG. 7), and the connectors 5 are preferably made of plastic, are integrally formed by injection molding, and are of a four-way bent structure on the whole. Wherein, the horizontal connecting ports for installing the middle cross tube 6 are oblate, the middle cross tube 6 is of a high-rigidity oblate structure and has high firmness, and each end of the middle cross tube 6 is inserted into the oblate hole of one connector 5 and is locked in the oblate hole with a self-tapping screw 15.

The two upper connecting ports in the upper end of each connector 5 are distributed in a U shape or a V shape and are respectively located at the front end and the rear end of the upper surface of the connector 5, and the angle of the U shape or the V shape is designed in accordance with the angle of a sitting space formed after the seat tubes 14 and the back tubes 13 are assembled.

Figure 6:
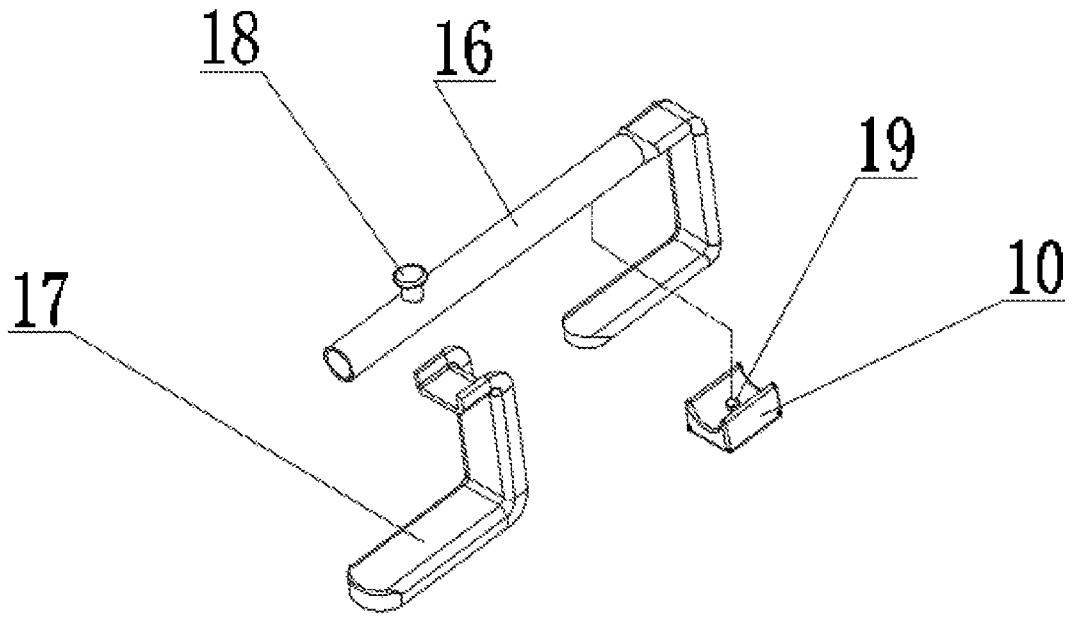
FIG. 6 is a disassembled diagram of a foot pad tube assembly.

Each foot pad tube assembly 4 (as shown in FIG. 6) primarily consists of a foot pad tube 16, a hook-type front pad 17, and a rear pad 10, wherein the foot pad tube 16 is formed by connecting a long tube segment and a flat hook segment; the head of the long tube segment is inserted into the front connecting port of the corresponding connector 5, and a pin 18 is arranged at a position, close to the head, of the long tube segment and is buckled in an arc-shaped clamping groove 20 of the front connecting port of the corresponding connector 5, so that the foot pad tube assembly 4 can be locked in one direction in use; a small hole is formed in the inner side, close to the hook segment, of the long tube segment, and a clamping protrusion 19 on the upper surface of the rear pad 10 is clamped and fixed in the small hole; and a clamping groove is formed in the surface of the hook-type front pad 17, and the hook segment is clamped in the clamping groove.

The long tube segment of the hook-type front pad 17 is a round tube, the upper surface of the rear pad is a concave arc surface matched with the outer wall of the round tube, and the lower surface of the rear pad is a horizontal plane. The side, towards the clamping protrusion 19, of the rear pad 10 is semicircular and wraps the outer circle of the round foot pad tube 16, and the other side of the rear pad 10 is planar to be supported on a movable bleacher 11.

The hook-type front pad 17 and the rear pad 10 are plastic pads; or, the foot pad tube 16 is a metal tube, such as an iron tube. The clamping protrusion 19 is made of plastic.

In this embodiment, the bleacher seat further comprises a storage bag 1, wherein the cloth cover 2, the tube insertion sleeves 9, and the bleacher seat support assembly 3 are stored in the storage bag 1.

With reference to the exploded view of one side of the bleacher seat (FIG. 4), one connector 5, one foot pad tube assembly 4, one self-tapping screw 15, two seat tubes 14, one back tube 8, one elastic rope 7, and two tube plugs 12 are arranged on each side of the bleacher seat, wherein the lower end, to be inserted into the corresponding seat tube 14, of the back tube 8 is designed as an insertion bar 13 with the outer circle matched with the inner circle of the seat tube 14, and the insertion bar is inserted into the seat tube; the tube plugs 12 are formed through injection molding; a knot 21 of the head end of the elastic rope 7 is hidden in an inner cavity of one tube plug 12, and a notch 22 allowing the knotted head end of the elastic rope 14 to be taken out and assembled is formed in the side wall of the tube plug 12, and the head end of the elastic rope 7 is arranged in the inner cavity of the tube plug 12 via the notch; and the elastic rope 14 penetrates through the two tube plugs 12, the two seat tubes 14, the back tube 8 and the connector 5.

Figure 1A:
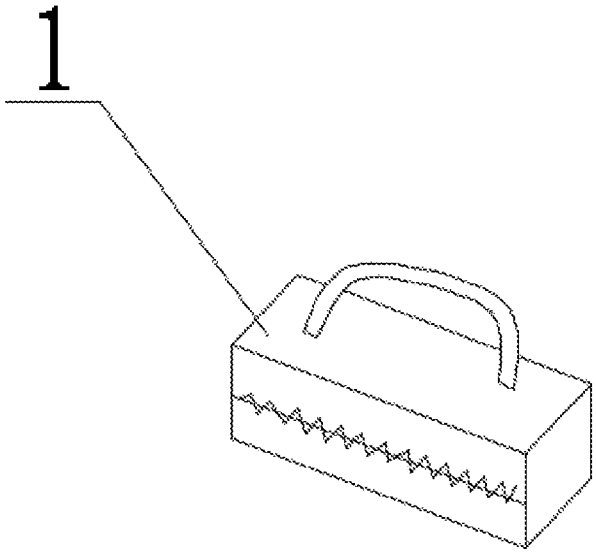
FIG. 1*a* is a structural diagram of a bleacher seat in a storage bag.
Figure 1B:
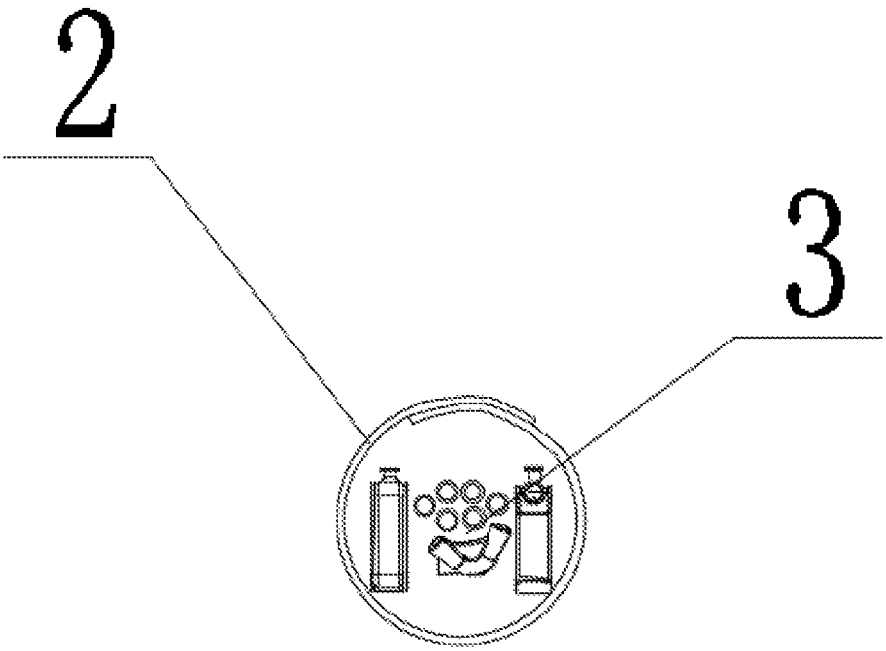
FIG. 1*b* is a structural diagram of the bleacher seat in a stored and packed state.
Figure 1C:
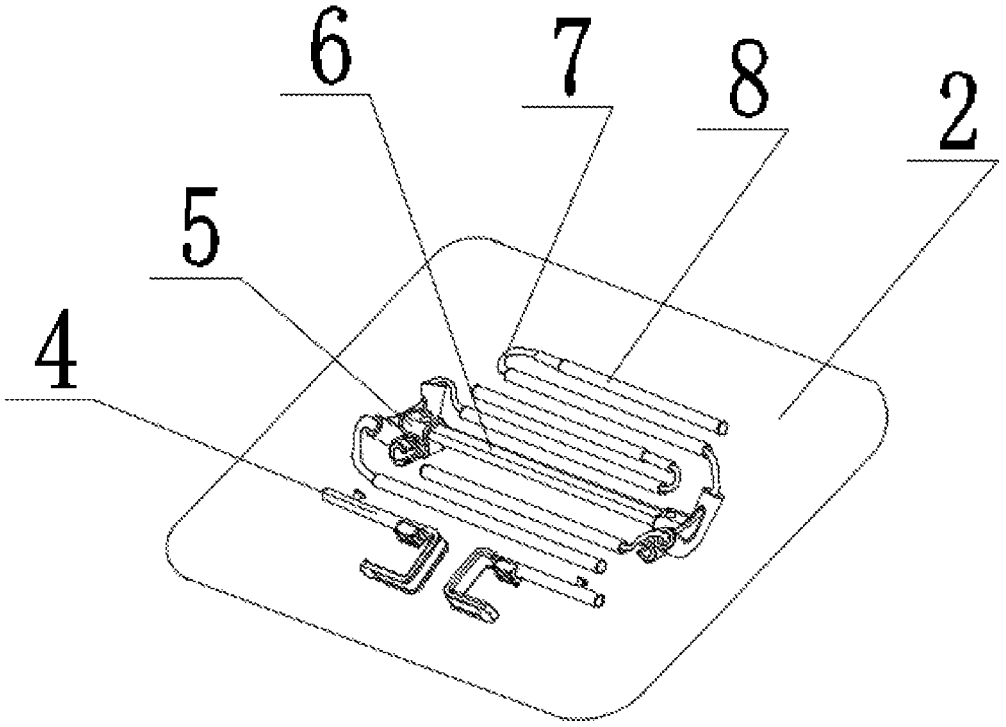
FIG. 1*c* is a structural diagram of the bleacher seat spread on a cloth cover.

As shown in FIG. 1*a*-FIG. 1*c*, the bleacher seat in this embodiment is folded and stored as follows: the cloth cover 2 is detached from the bleacher seat support assembly 3 and spread on a clean floor, and then the foot pad tube assemblies 4 are rotated outwards by 90° with respect to the outer side of the bleacher seat support assembly 3 and are then pulled out; afterwards, the back tubes 8 and the seat tubes 14 are pulled out of the connectors 5 under the elastic effect of the elastic ropes 7, and all these parts are arrayed in parallel with the middle cross tube 6 and are then placed on the cloth cover 2 (as shown in FIG. 1*c*); and the cloth cover 2 wraps the disassembled bleacher seat support assembly 3, is then rolled into a cylinder (as shown in FIG. 1*b*), and is finally placed in the storage bag 1 (as shown in FIG. 1*a*).

Figure 3:
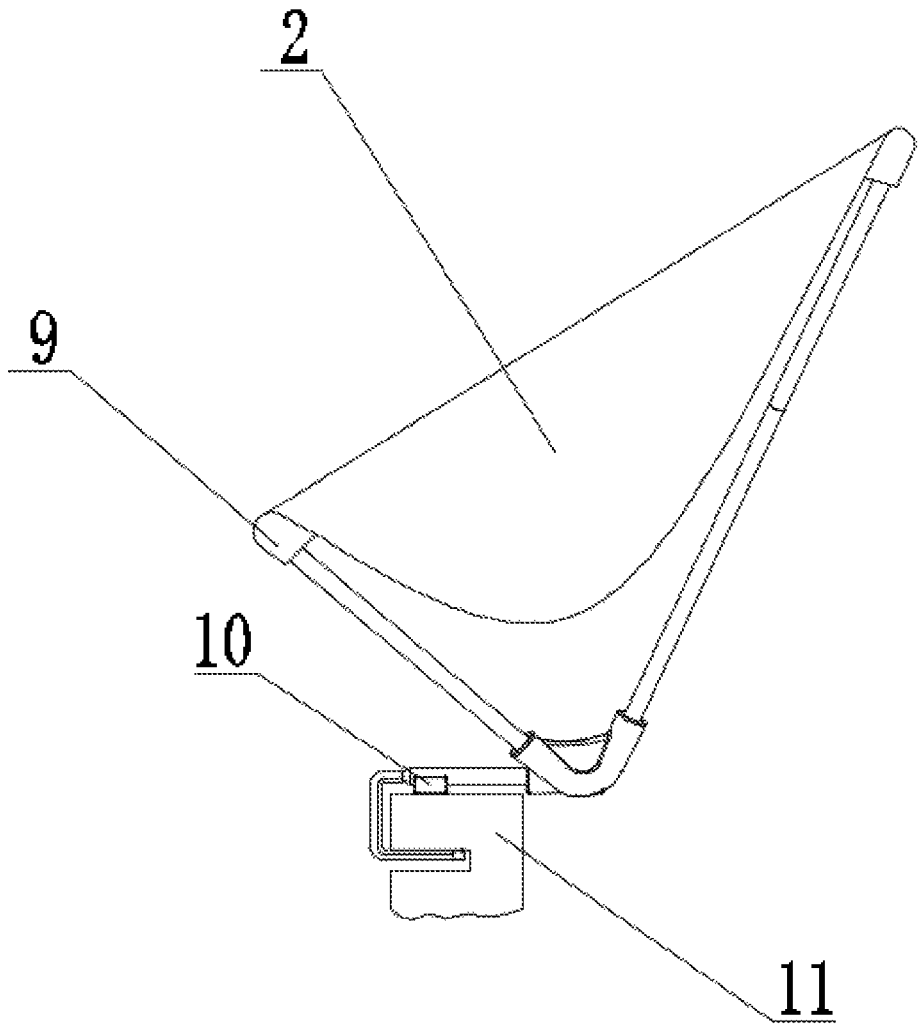
FIG. 3 is a schematic diagram of the bleacher seat in a working condition.

As shown in FIG. 2 and FIG. 3, when the bleacher seat in this embodiment is unfolded to be used, the bleacher seat is reversely operated to be unfolded, then the unfolded bleacher seat is installed on the movable bleacher 11 by means of the foot pad tube assemblies 4, at this moment, the plastic pads 10 on the foot pad tube assemblies 14 are pressed against the plane of the movable bleacher 11, and the hook segments of the foot pad tube assemblies 4 are hooked in concave parts of the movable bleacher 11.

The aforementioned embodiments are only preferred ones of the utility model, and are not intended to limit the protection scope of the utility mode, and all transformations and improvements made by those skilled in the art according to the design concept of the utility model should fall within the protection scope of the utility model. More particularly, various transformations and improvements can be made to the constituent parts and/or the layout of the subject matter within the scope of the drawings and claims of this application. In addition to these transformations and improvements to the constituent parts and/or the layout, other applications will also be obvious to those skilled in the art.

What is claimed is:

1. A bleacher seat, comprising a cloth cover, tube insertion sleeves and a bleacher seat support assembly, wherein the bleacher seat support assembly comprises two foot pad tube assemblies, two back tubes, two front seat tubes, four tube plugs, four seat tubes, a middle cross tube, two connectors, and two elastic ropes;

each said connector is of a four-way connecting port structure, horizontal connecting ports of the two connectors are respectively connected to two ends of the middle cross tube, front connecting ports of the two connectors are respectively connected to the foot pad tube assemblies, two upper connecting ports which are internally communicated with each other are formed in an upper end of each said connector, each said upper connecting port is connected to a lower end of one said seat tube, and an upper end of each rear seat tube is connected to one said back tube;

the four tube plugs are respectively installed at upper ports of said two front seat tubes and upper ports of the two back tubes;

each said elastic rope has an end fixed to the tube plug at the upper end of the corresponding back tube and then sequentially penetrates through the back tube on a same side, the seat tube at a lower end of the back tube, the two communicated upper connecting ports of the corresponding connector, and the corresponding front seat tube to be fixed to the tube plug on the corresponding front seat tube; and four corners of the cloth cover respectively sleeves upper ends of the two front seat tubes and upper ends of the two back tubes by means of the tube insertion sleeves.

2. The bleacher seat according to claim 1, wherein the two upper connecting ports in the upper end of each said connector are distributed in a U shape or a V shape and are respectively located at a front end and a rear end of an upper surface of the connector.

3. The bleacher seat according to claim 1, wherein the connectors are plastic connectors or cast connectors, or other four-way structural parts.

4. The bleacher seat according to claim 1, wherein each said foot pad tube assembly comprises a foot pad tube, a hook-type front pad and a rear pad, wherein the foot pad tube is formed by connecting a long tube segment and a flat hook segment, a head of the long tube segment is inserted into the front connecting port of the corresponding connector, and a pin is arranged at a position, close to the head, of the long tube segment and is buckled in an arc-shaped clamping groove of the front connecting port of the corresponding connector; a small hole is formed in a position, close to the hook segment, of the long tube segment, and a clamping protrusion on an upper surface of the rear pad is clamped in the small hole; and a clamping groove is formed in a surface of the hook-type front pad, and the hook segment is clamped in the clamping groove.

5. The bleacher seat according to claim 4, wherein the long tube segment is a round tube, an upper surface of the rear pad is a concave arc surface matched with an outer wall of the round tube, and a lower surface of the rear pad is a horizontal plane.

6. The bleacher seat according to claim 4, wherein the hook-type front pad and the rear pad are plastic pads; or, the foot pad tube is a metal tube.

7. The bleacher seat according to claim 1, further comprising a storage bag, wherein the cloth cover, the tube insertion sleeves and the bleacher seat support assembly are stored in the storage bag.

8. The bleacher seat according to claim 1, wherein notches allowing knots at head ends of the elastic ropes to be taken out and assembled are formed in side walls of the tube plugs, and the head ends of the elastic ropes are arranged in inner cavities of the tube plugs via the notches.

9. The bleacher seat according to claim 2, wherein notches allowing knots at head ends of the elastic ropes to be taken out and assembled are formed in side walls of the tube plugs, and the head ends of the elastic ropes are arranged in inner cavities of the tube plugs via the notches.

10. The bleacher seat according to claim 3, wherein notches allowing knots at head ends of the elastic ropes to be taken out and assembled are formed in side walls of the tube plugs, and the head ends of the elastic ropes are arranged in inner cavities of the tube plugs via the notches.

11. The bleacher seat according to claim 4, wherein notches allowing knots at head ends of the elastic ropes to be taken out and assembled are formed in side walls of the tube plugs, and the head ends of the elastic ropes are arranged in inner cavities of the tube plugs via the notches.

12. The bleacher seat according to claim 5, wherein notches allowing knots at head ends of the elastic ropes to be taken out and assembled are formed in side walls of the tube plugs, and the head ends of the elastic ropes are arranged in inner cavities of the tube plugs via the notches.

13. The bleacher seat according to claim 6, wherein notches allowing knots at head ends of the elastic ropes to be taken out and assembled are formed in side walls of the tube plugs, and the head ends of the elastic ropes are arranged in inner cavities of the tube plugs via the notches.

14. The bleacher seat according to claim 7, wherein notches allowing knots at head ends of the elastic ropes to be taken out and assembled are formed in side walls of the tube plugs, and the head ends of the elastic ropes are arranged in inner cavities of the tube plugs via the notches.

15. The bleacher seat according to claim 1, wherein the lower ends of the back tubes are designed as insertion bars with outer circles matched with inner circles of the seat tubes, and the insertion bars are inserted into the seat tubes.

16. The bleacher seat according to claim 2, wherein the lower ends of the back tubes are designed as insertion bars with outer circles matched with inner circles of the seat tubes, and the insertion bars are inserted into the seat tubes.

17. The bleacher seat according to claim 3, wherein the lower ends of the back tubes are designed as insertion bars with outer circles matched with inner circles of the seat tubes, and the insertion bars are inserted into the seat tubes.

18. The bleacher seat according to claim 4, wherein the lower ends of the back tubes are designed as insertion bars with outer circles matched with inner circles of the seat tubes, and the insertion bars are inserted into the seat tubes.

19. The bleacher seat according to claim 5, wherein the lower ends of the back tubes are designed as insertion bars with outer circles matched with inner circles of the seat tubes, and the insertion bars are inserted into the seat tubes.

20. The bleacher seat according to claim 6, wherein the lower ends of the back tubes are designed as insertion bars with outer circles matched with inner circles of the seat tubes, and the insertion bars are inserted into the seat tubes.

* * * * *